United States Patent [19]

Wiebe et al.

[11] Patent Number: 5,042,286

[45] Date of Patent: Aug. 27, 1991

[54] MANUALLY OPERATED PLIERS-TYPE TOOL

[75] Inventors: Ulrich Wiebe, Dörentrup; Hartmut Schmode, Blomberg; Karl-Heinz Siemens, Lemgo; Jörg Gondermann, Detmold, all of Fed. Rep. of Germany; Hans Undin, Åkersberga, Sweden

[73] Assignee: C.A. Weidmuller GmbH & Co., Detmold, Fed. Rep. of Germany

[21] Appl. No.: 444,698

[22] Filed: Dec. 1, 1989

Related U.S. Application Data

[63] Continuation-in-part of Ser. No. 321,235, Mar. 9, 1989, abandoned, and a continuation-in-part of Ser. No. 433,479, Nov. 9, 1989, Pat. No. 4,982,630.

[30] Foreign Application Priority Data

May 9, 1988 [SE] Sweden ..... 8801737
Nov. 11, 1988 [SE] Sweden ..... 8804083

[51] Int. Cl.[5] ..... B21D 7/06; H01R 43/042

[52] U.S. Cl. ..... 72/414; 72/410; 72/461; 29/751; 81/313; 81/363; 81/420

[58] Field of Search ..... 72/410, 409, 414, 413, 72/461; 81/367, 375-380, 420, 427.5, 406, 342, 355-363, 129, 150, 151, 313; 29/751

[56] References Cited

U.S. PATENT DOCUMENTS

| | | | |
|---|---|---|---|
| 2,592,803 | 4/1952 | Heim | 81/369 |
| 2,743,634 | 5/1956 | Badeau | 81/376 |
| 3,170,345 | 2/1965 | Poingt | 72/409 |
| 3,204,445 | 9/1965 | Filia | 72/410 |
| 3,230,757 | 1/1966 | Filia | 72/410 |
| 3,322,008 | 5/1967 | Filia | 81/368 |
| 3,417,599 | 12/1968 | Burns | 72/410 |
| 3,456,349 | 7/1969 | Heimann | 81/362 |
| 3,526,945 | 9/1970 | Ray | 29/751 |
| 3,575,037 | 4/1971 | Porter . | |
| 4,381,661 | 5/1983 | Wiener | 72/409 |
| 4,499,797 | 2/1985 | Wilson . | |
| 4,758,188 | 7/1988 | Yates . | |
| 4,794,780 | 1/1989 | Battenfeld | 72/410 |

FOREIGN PATENT DOCUMENTS

| | | | |
|---|---|---|---|
| 670267 | 9/1963 | Canada | 72/410 |
| 913346 | 10/1972 | Canada . | |
| 0344826 | 3/1989 | European Pat. Off. . | |
| 0368824 | 10/1989 | European Pat. Off. . | |
| 2301830 | 7/1974 | Fed. Rep. of Germany . | |
| 1033112 | 6/1966 | United Kingdom | 72/410 |
| 1522144 | 8/1978 | United Kingdom | 72/410 |
| 2060462 | 10/1979 | United Kingdom . | |
| 2072081 | 1/1984 | United Kingdom . | |

*Primary Examiner*—Daniel C. Crane
*Attorney, Agent, or Firm*—Cushman, Darby & Cushman

[57] ABSTRACT

In a manually operated pliers-type tool comprising an elongated tool body with a part defining an operative section with two carrier means for operative means such as crimping die members, and a longitudinal operating lever, which is journalled to the tool body and together therewith defines a reverse handle arrangement, projects that part of the tool body and tool, which defines the operative section, in the direction from which the operating lever is attached to the tool body, and the operating lever terminates, in its folded-down position, before that projecting part, and is level therewith. In a preferred embodiment, one of the carrier means is embodied by at least one rocker which is pivotably mounted in the operative section with the aid of a resilient means, so that the respective operative means may recede to a certain degree under the effect of predetermined load.

26 Claims, 4 Drawing Sheets

Fig. 4
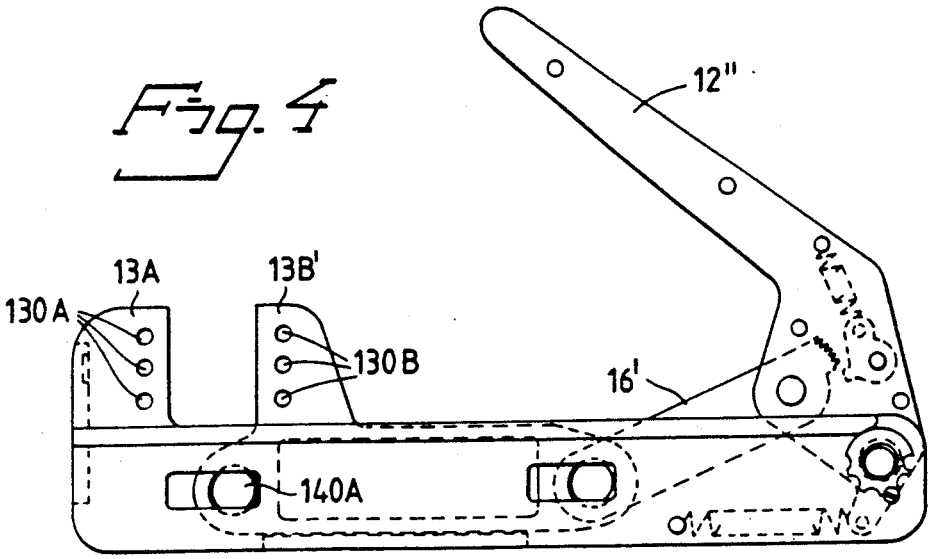
Fig. 5
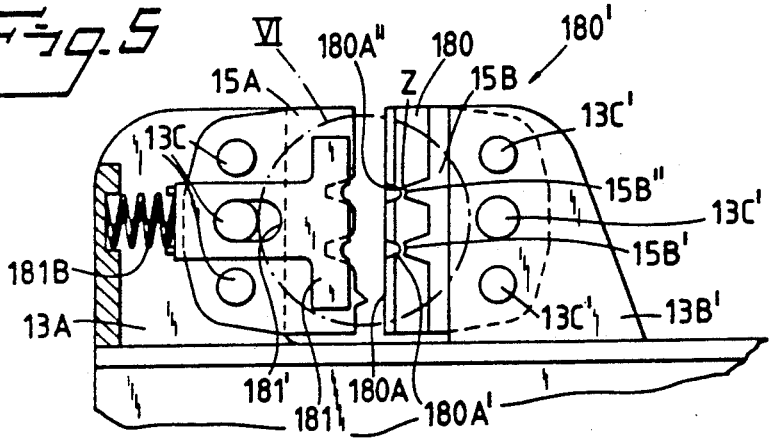
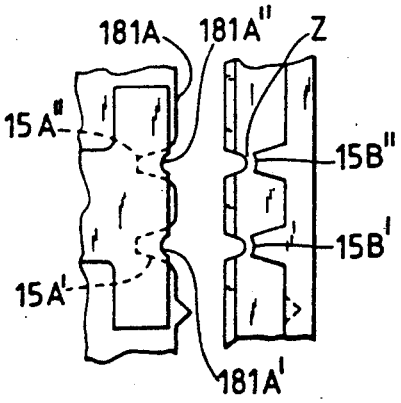
Fig. 6
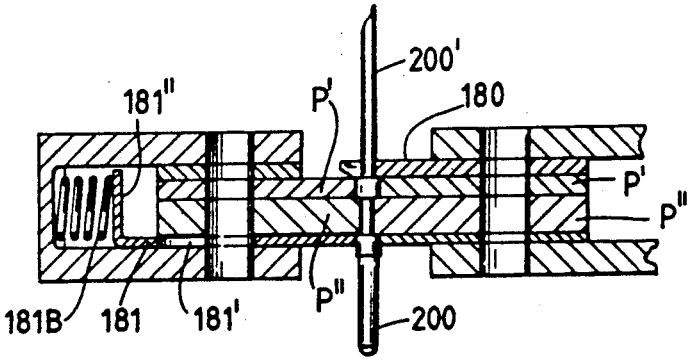
Fig. 7

Fig. 11A
Fig. 11
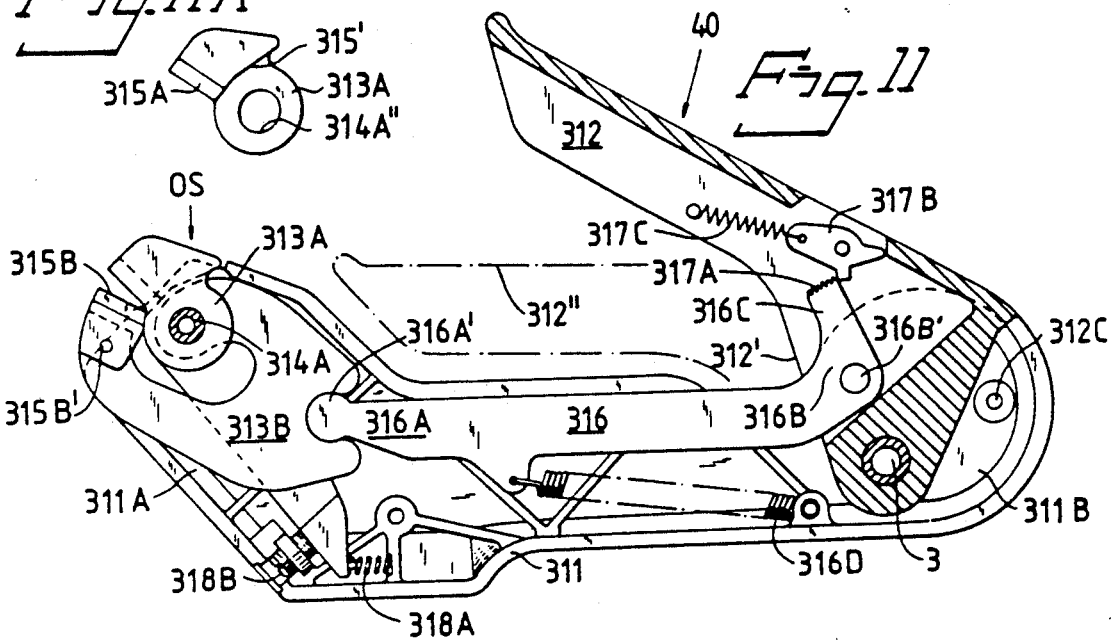
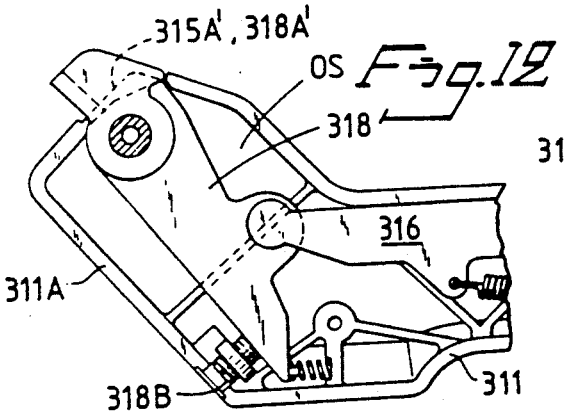
Fig. 12
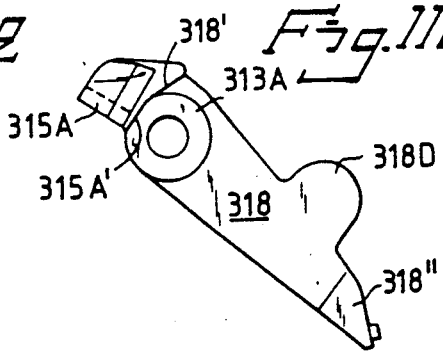
Fig. 11B
Fig. 13
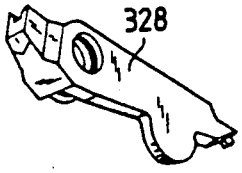
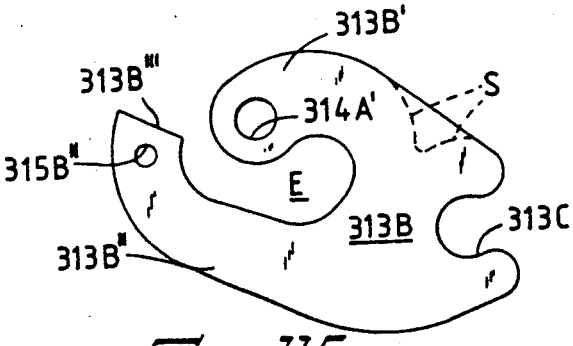
Fig. 11C

MANUALLY OPERATED PLIERS-TYPE TOOL

This application constitutes a continuation-in-part of application, Ser. No. 07/321,235, entitled "Hand Tool", filed Mar. 9, 1989, now abandoned, and application, Ser. No. 07/433,479, entitled "Pliers-Type Tool", filed Nov. 9, 1989, now U.S. Pat. No. 4,982,630.

FIELD OF THE INVENTION

The present invention refers to a manually operated pliers-type tool comprising, in combination, an elongated tool body, embodying a first handle means and having a first terminal part, an intermediate part, and a second terminal part; an operative section at said first terminal part for treating a workpiece by compression, such as to crimp it, and comprising a first carrier means for supporting a first operative means such as a crimping die member, and a second carrier means for supporting a second operative means such as a crimping die member, the second carrier means being movable relative the first carrier means; a longitudinal operating lever, embodying a second handle means and having a first end, where it with the aid of a lever pivot pin is journalled to the said second terminal part for pivotal movement between a swung-out position and a folded-down position, so as to define together with the tool body a reversed handle arrangement; and a rigid driving rod means, having a first end, where it by a first pivot means is attached to the second carrier means, and a second end, where it with the aid of a second pivot means is attached to the operating lever spacedly from the lever pivot pin, so as to define together with the operating lever a toggle mechanism for transmitting force and motion to the second carrier means.

By "carrier means" is in the present description and in the annexed claims understood a means carrying, or adapted to carry, an operative means.

BACKGROUND OF THE INVENTION

In tools of this kind is the operating lever, when the tool is in its position of use, located under the hand of the user, which better corresponds to the width of the user's open hand, and which, among other things, has the advantage that the operating lever may be readily reached and grasped with the longest fingers of the hand even in the maximally open position of the tool.

A tool of this kind, equiped with crimping die, and provided with a so-called motion compelling mechanism for preventing premature interruption of the second carrier means' operative motion is e.g. described in U.S. Pat. No. 3,204,445 to G. J. Filia. Said mechanism comprises a spring-affected pawl which is pivotally mounted on the operating lever and engages a rachet which is arranged on a separate bell-crank lever.

Both said levers are for adjusting purposes mounted on an eccentric middle part of a pivot pin which is anchored in the tool body with its two concentric terminal parts.

OBJECT OF THE INVENTION

It is an object of the present invention to provide an improved hand operated tool of the above said kind which has a simple construction and a to a high degree space-saving shape, and which tool, when equiped with crimping die members, may be used e.g. as front-input crimping pliers which are operable with low hand force and which in particular are suited for crimping so-called Aderend sleeves according to European Standard and which lie within a certain range of cross-sectional areas, e.g. of approximately 0,25 $mm^2$ to 1,5 $mm^2$.

Another object of the invention is to provide in a tool of the kind specified a locator for exactly positioning, relative a die member element, a connector such as a cable eye, and/or an electrical conductor inserted therein, already before the connector becomes engaged by a co-operating other die member element.

A further object of the invention is to provide a tool of the kind specified in which the carrier means execute a scissors-like approaching movement and work-pieces of various sizes (within a certain range) can be precisely treated without re-setting the tool, one carrier means yielding under pretermined load.

In accordance with one aspect of the present invention, that part of the tool body and tool, where the operative section is located, projects relative the said intermediate part in the direction from which the operating lever is attached to the tool body, and the operating lever terminates, in its folded-down position, before that projecting part, and is level therewith.

In accordance with another aspect of the present invention, the second die member carrier means is embodied by at least one rocker which is pivotably mounted in the operative section, is provided with an opening for a pin or bolt, and comprises, spacedly from said opening, an area for affixing the second operative means, a resilient means being interposed between said opening and said area, so that the second operative means may, when affected by a predetermined load, recede due to deformation of the resilient means.

BRIEF DESCRIPTION OF THE DRAWINGS

FIG. 4 shows the tool of FIG. 3 in open position;

FIG. 5 is a lateral view, at a larger scale, of the operative section of the tool of FIG. 4 with die and locator members affixed;

FIG. 6 shows at a still larger scale the portion VI in FIG. 5;

FIG. 7 is a plan view of the tool of FIGS. 5 and 6;

FIG. 11 is a lateral view of a fourth embodiment of the tool according to the invention in open position;

FIG. 11A is a lateral view of the rocker of FIG. 11;

FIG. 11B is a lateral view of the die beam of FIG. 11;

FIG. 11C is a lateral view of the second carrier in the tool of FIG. 11;

FIG. 12 is a view of the operative section of the tool of FIG. 11 with the rocker means removed, and FIG. 13 is a perspective view, at a smaller scale, of an alternative embodiment of the die beam of FIG. 11B.

DESCRIPTION OF PREFERRED EMBODIMENTS

Figure 1:
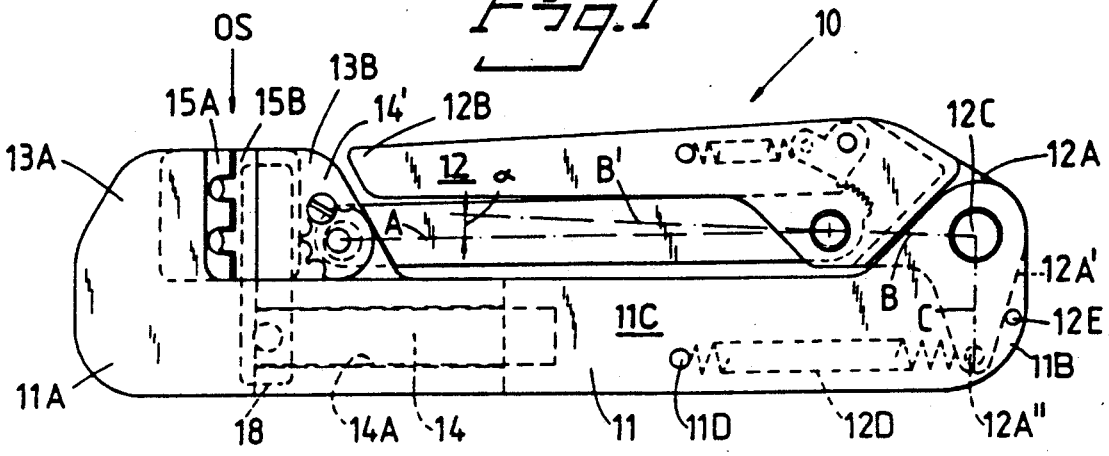
FIG. 1 is a lateral view of a first embodiment of the tool according to the invention in closed position.
Figure 2:
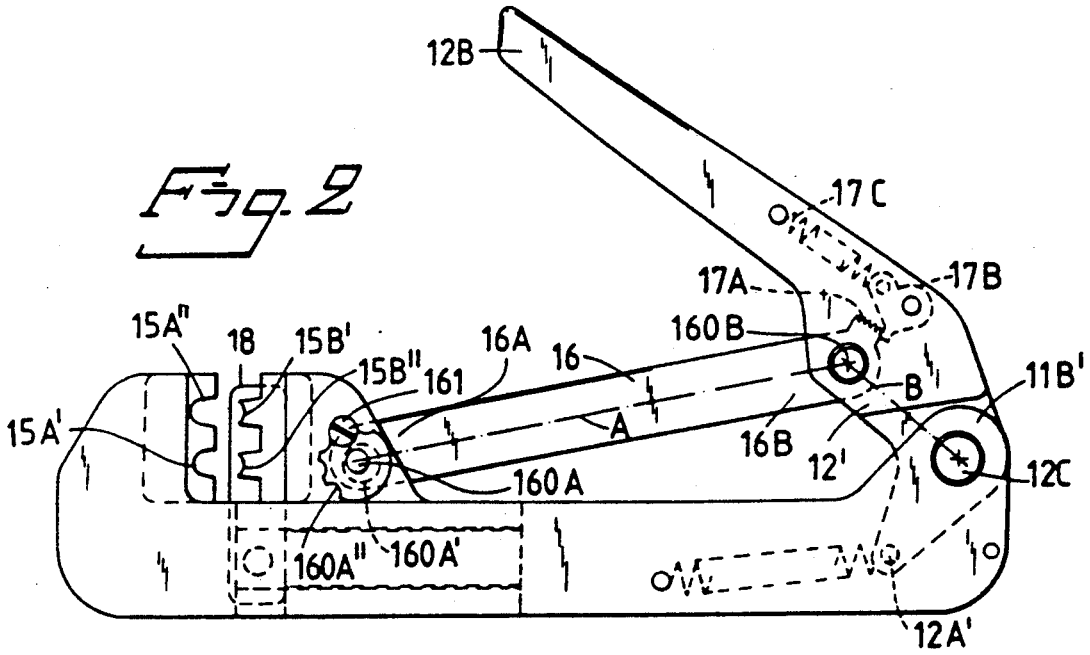
FIG. 2 is the same view showing the tool in open position.

A tool according to the invention, in a first embodiment 10 thereof, as shown in FIGS. 1 and 2, has a longitudinal, handle-shaped tool body 11 which embodies a handle means and has a first terminal part 11A, where an operative section OS is accommodated, an opposite second terminal part 11B, where an operating lever 12 is journalled to the tool body 11 with the aid of a lever pivot pin 12C, and an intermediate part 11C, which extends between the two said terminal parts 11A, 11B.

The operative section OS comprises a first carrier means 13A, which is rigidly attached to, and preferably embodied by, an extreme end portion of the tool body 11, and a second carrier means 13B means which is defined by a slide member 14, which is mounted in a rectilinear track 14A in the tool body 11 for reciprocating movement toward and away from the first carrier means 13A, and a web 14' which is rigidly attached to or integral with the slide 14.

The first and the second carrier means 13A, 13B are adapted to support, preferably in exchangeable manner, a first and a second operative means respectively, in the instance die members 15A, 15B, each of which comprises one, and preferably several (in the illustrated example two) die elements 15A', 15A'' and 15B', 15B'' respectively. At least one of the die members 15A, 15B may be mounted on its carrier means settably, e.g. with the aid of setting screws, so that the mutual position of the two die members may be, with unchanged mutual position of the two carrier means 13A, 13B, changed within a small range, sufficient for adjusting purposes.

A locator, embodied by a flat arm or a flat link 18, which is unmovably attached to the tool body 11 in the area where the movable second carrier 13B is located in its retracted or "open" position, defines the position of a working piece such as a cable eye, and/or a conductor inserted into the cable eye, when it is positioned in one of the die elements.

The lever pivot pin 12C is mounted in a projecting part 11B' at the second terminal part 11B of the tool body 11, and extends in the direction away from the tool body 11 as the operating lever 12 is attached from, i.e. in the same direction, as the two carriers 13A, 13B extend.

The operating lever 12 embodies a second handle means and has at its first end 12A a broader part 12', from which extends a projection 12A', at the free end 12A'' of which is a tension spring 12E anchored. The tension spring 12E, whose other end is anchored in the tool body 11 at a location 11D, tends to keep the tool 10 in open position, i.e. with the operating lever 12 fully swung-out, and the two carriers 13A, 13B maximally spaced apart.

The lever pivot pin 12C passes through the broader part 12' of the operating lever 12. The second end 12B of the lever 12 is free.

A rigid driving rod means 16, embodied in this instance by a single driving rod, is at its first end 16A pivoted to the second carrier 13B with the aid of a pivot means, defined by a pivot pin 160A, and at its other end 16B to the operating lever 12, spacedly from the lever pivot pin 12C (i.e. between the lever pivot pin 11C and the free end 12B of the lever 12), with the aid of another pivot means, also defined by a pivot pin 160B.

The driving rod 16 extends, particularly in the closed position of the tool, substantially parallel with the tool body 11. A straight line B connecting the lever pivot pin 12C with the pivot pin 160B (by a connecting line between two pins or bolts is in this description and in the enclosed claims understood the shortest line interconnecting the axes of the respective pins or bolts) subtends substantially a right angle (e.g. an angle of $90° +/- 10°$) with a straight line C connecting the lever pivot pin 12C with the point of attachment of the spring 12D to the projection 12A'.

The tool has in the closed position shown in FIG. 1 an extremely space-saving shape, the operating lever 12 ending, in its folded-back position, before the operative part OS and being level with therewith, i.e. the free end 12B thereof not projecting over the two carrier means 13A, 13B, which of course would increase the height dimension of the folded tool.

The pivot pin 160A may be in known manner be eccentric, so as to enable adjustment of the position of the second carrier 13B relative the first carrier 13A, which functionally substitutes the above mentioned adjustable mounting of at least one of the die members 15A, 15B with the aid of setting screws.

Such an eccentric bolt 160A has a central portion 160' on which is the driving rod 16 mounted, and which is eccentric relative the two end portions of the bolt, which are mounted in carrier 13B, the rotational position of the bolt 160A, and thereby the effective length of the driving rod 16, being adjustable with the aid of an adjustment disc 160'' with peripheral indentations for a fixing screw 161.

Figure 3:
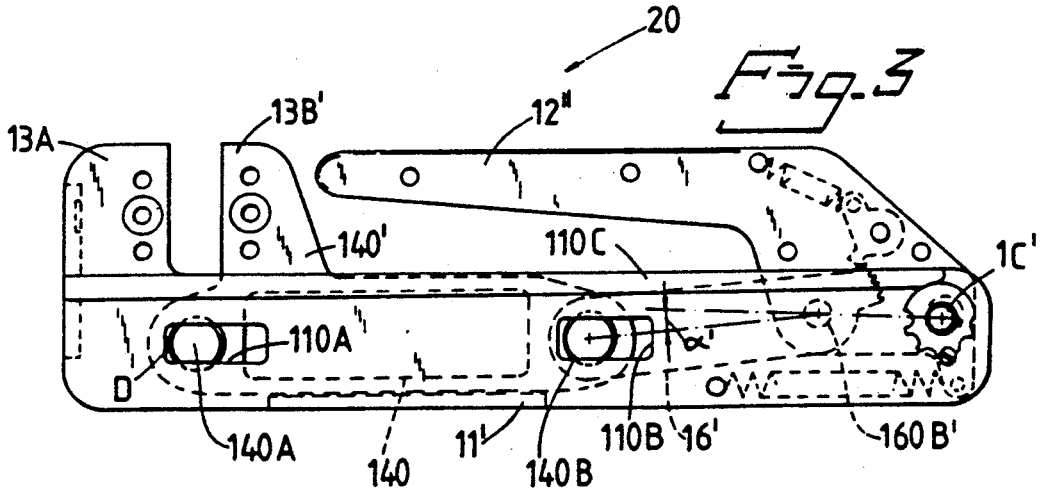
FIG. 3 is a lateral view of a second embodiment of the tool according to the invention (without die members) when approaching the closed position.

It will be readily understood that for adjustment of the mutual position of the two carriers 13A, 13B in their closed position also the other pivot pin 160B, or, as shown in FIG. 3, the lever pivot pin 12C may be made in the said manner.

At the second end 16B of the driving rod 16 is a short arcuate ratchet 17A provided, which together with a pivotally mounted, spring-affected (tension spring 17C) pawl 17B defines a motion-compelling mechanism of a known kind.

An extension B' of the connecting line B beyond the pin 160B subtends, in the closed position of the tool shown in FIG. 1, an acute angle $\alpha$ of less than 10° with a line A connecting the two pivot pins 160A, 160B (and which also defines the longitudinal axis of the driving rod 16). The line B' extends, in the example shown in FIG. 1, on that side of the line A which is adjacent the operating lever 12.

From FIG. 1 will be understood that the angle $\alpha$, and thereby the kind and degree of the obtained toggle effect, may be varied by adjusting the pin 160A. The lines A and B' may, in the closed position of the tool shown in FIG. 1, in principle also co-incide, or the line B' may extend on the opposite side of line A than in the drawing.

However, the tool according to the invention is advantageously made so, that the toggle mechanism, defined by the operating lever 12 and the driving rod 16, is stopped in an operative stroke (i.e. when the two handle means are closed) before it reaches its fully stretched position (where the angle $\alpha$ would be zero) in which it would be locked, so that no separate unlocking or release lever or the like is needed. Adjusting an eccentric pin 160A, 160B or 11C is one way how this condition may be achieved. A stop bolt 12E assures the stop position of the operating lever 12, and may be, alternatively, also made settable.

The tool 20 of FIGS. 3 and 4 is provided with a second carrier 13B' which consists of a slide 140 and a web 140' which is rigidly attached thereto. The slide 140 is with the aid of guide taps 140A, 140B slidably mounted in longitudinal slots or openings 110A, 110B which are spacedly arranged in the tool body 11' and define a rectilinear track for the second carrier 13B'.

The length of the reciprocating motion of the second carrier means 13B' depends on the length of the longitudinal openings 140A, 140B, and the left hand ends (as seen in the drawing) of these openings fill the function of the stop means 12D of FIG. 1.

In the example shown, a short distance D is still left before the guide taps 140A, 140B come to abut against the left hand ends of the openings 100A, 110B, i.e. before the most closed position of the tool 20 is reached, and the angle $\alpha'$ becomes still somewhat smaller.

The driving rod 16' is with the aid of the pivot pin 160B' pivoted to the operating lever 12'' in the same way as in the tool 10, whereas it is pivoted to the slide 140 with the aid of one of the guide taps, viz. tap 140B, which thus also defines a pivot pin means.

The lever pivot pin 12C' is eccentric as described above, and to the same purposes.

According to FIGS. 5 to 7, a die member 15B with two projecting die elements 15B' and 15B'', and a locator 180' are mounted on the second carrier 13B' of the tool 20, e.g. with the aid of three bolts 13C' inserted in the openings 130B (FIG. 4). The locator, which, in contradistinction to the embodiment 10, follows the movements of the second carrier 13B', is embodied by a link 180 having a terminal edge 180A in which there are arranged two recesses 180A', 180A'' adjacently the two die elements 15B', 15B'' respectively.

The recesses terminate a short distance Z above the die elements 15B', 15B'', meaning that their lowest point lies somewhat above the adjacent die element surface, i.e. closer to the terminal edge 180A than the respective die element. The distance Z is substantially equal to the thickness of the plate material from which the the cable eys, which shall be treated by the tool, are made.

Under these circumstances, a cable eye 200 (FIG. 7), positioned on the die element, abuts on the locator 180', but a conductor 200' can be introduced into the cable eye 200 through one of the recesses 180A', 180A''.

Analogically, a die member 15A with recessed die elements 15A', 15A'' is with the aid of three pins 13C, inserted into the openings 130A (FIG. 4), attached to the stationary first carrier 13A in the tool 20. Instead of the locator 180' on the carrier 13B', a spring-affected (compression spring 181B), T-shaped plate 181 is slidably mounted on the carrier 13A. The plate 181 defines a co-operating locator part and it can, thanks to a longitudinal opening 181', glide on at least one of the pins 13C, in the example shown on the central one.

The plate 181 is on its terminal edge 181A also provided with two recesses 181A', 181'' which are located adjacent the recessed die elements 15A', 15A'' of the die member 15A. The lowest point of the recesses 181A', 181'' lies, in the most advanced position of the plate 181 relative the die member 15A, shown in FIGS. 5 and 6, "higher", i.e. closer to the terminal edge 181A, than the lowest point on the adjacent die elements 15B', 15B''.

The plate 181 has, opposite the terminal edge 181, a bent-off end portion 181'' where it is constantly affected by said compression spring 181B. The longitudinal opening 181' defines by its length the extend of the plate's 181 travel, and thereby also its most advanced position, shown in FIGS. 5 and 6.

Each of the two die members 15A, 15B consists, as best seen in FIG. 7, of two plates P', P'' for crimping two different parts of a cable eye 200, viz. the part comprising the stripped portion of the conductor (plate P''), and the part comprising the insulated portion of the conductor (plate P').

When the cable eye or the crimp sleeve 200 is inserted into one of the die elements 15B', 15B'', the locator 180' defines its correct position. Then the tool is so far closed, that the crimp tags, i.e. these parts of a crimping contact such as cable eye or the like, which after the crimping operation surround the conductor and/or its insulation, strike against the juxtaposed die element 15A', 15A''. The operator inserts then with his free hand the conductor 200' into the respective pair of die elements 15A',15B' or 15A'', 15B'' (or, in the case of longer cable eyes, inserts the conductor 200' directly into the cable eye), the conductor 200' being hereat positioned by the plate 181.

Figure 8A:
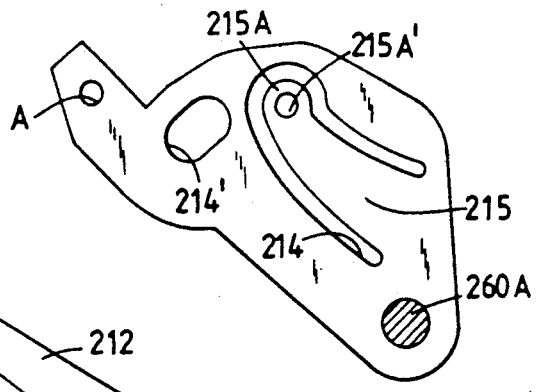
FIG. 8A is a lateral view of the rocker of FIG. 8 at a larger scale.
Figure 8:
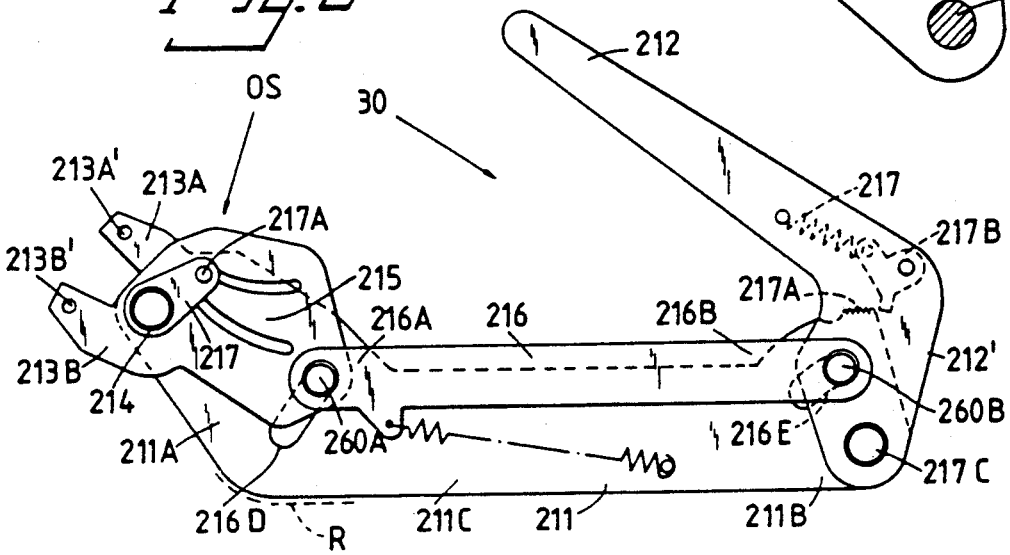
FIG. 8 is a lateral view of a third embodiment of the tool according to the invention in open position and with removed housing.
Figure 9:
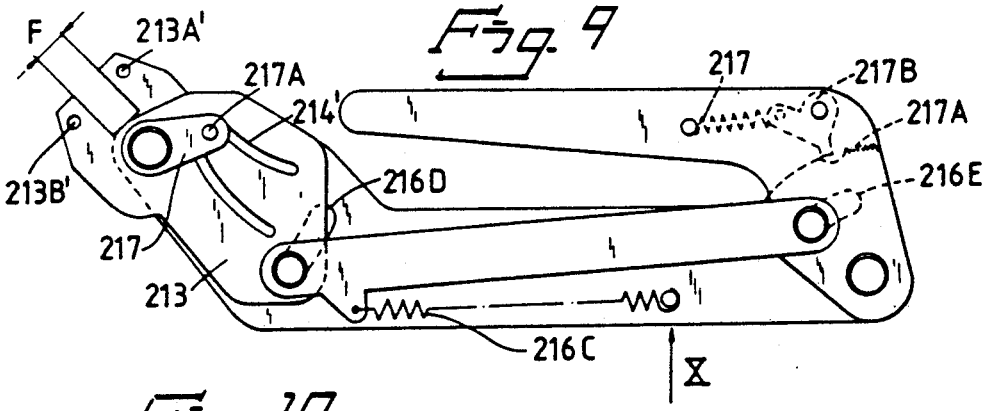
FIG. 9 is a lateral view of the tool of FIG. 9 in closed position.
Figure 10:
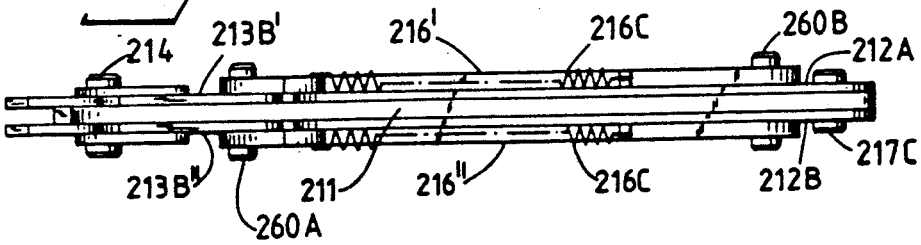
FIG. 10 is a view of the tool of FIG. 9 in the sense of arrow X in FIG. 9.

The tool 30 according to FIGS. 8 to 10 has an elongated tool body 211 with a first terminal part 211A, where an operative section OS is located, an intermediate part 211C, and a second terminal part 211B, where an operating lever 212 is journalled to the tool body 211 with the aid of a lever pivot pin 217C.

The operative section OS comprises a first carrier means 213A, which is firmly attached to the first terminal part 211A, and preferably is integral therewith, and a movable second carrier means 213B, which is embodied by a rocker means. The rocker means 213B is with the aid of a pivot means, defined by a rocker pivot pin 214 anchored in the tool body 211, journalled to the tool body 211 in a manner which will be explained more in detail below.

Each of the carriers 213A, 213B supports, preferably in exchangeable manner, an operative means, e.g. one of the above said crimping die members, not shown for clarity in the FIGS. 8 to 10, and for the attachment of which, e.g. with the aid of screw bolts or the like, are holes such as 213A', 213B' provided in the carriers.

The first terminal part 211A, where the operative section OS is located, is bent upward, i.e. in the direction from which the operating lever 212 is attached to the tool body. The operating lever 212 has at its attachment end a broader part 212', which is also bent-off, and in which the lever pivot pin 217C is located.

A rigid driving rod means 216, in the instance defined by two parallel driving rods 216', 216'' (FIG. 10), is at its first end 216A attached to the rocker means 213B, spacedly from the rocker pivot pin 214, with the aid of a pivot pin 260A, and is at its second end 216B with the aid of a pivot pin 260B pivoted to the operating lever 212 within the broader part 212' thereof.

The driving rod means 216 extends substantially parallel with the tool body 211, in particular in the closed position of the tool (FIG. 9).

The tool body 211, inclusive of the first carrier 213A, is preferably embodied by a flat, longitudinal plate, e.g. of steel, and the rocker means 213B defining the second carrier means is preferably, as seen in FIG. 10, embodied by one rocker/carrier member 213B', 213B'' on each side of the tool body 211.

Analogically, the driving rod means is embodied by one driving rod member 216', 216'' on each side of the tool body 211.

The two members in each such pair are interconnected by the said pins 214, 260A, and 260B. Arcuate slots 216D, 216E having their centres of curvature in the pivot pins 214 and 217C respectively, are provided in the tool body 211 in order to allow for the pins 260A, 260B to pass through the tool body 211, and at the same time to move along a circular path when the parts 212 and 213B are rotated. At least one of the slots 216D, 216E may by its length define an end stop means limiting said rotary motion.

The operating lever 212 has at least in its broader part 212' the profile of a reversed U, and straddles with its two legs 212A, 212B (FIG. 10) the tool body 211. The lever pivot pin 217C passes through circular holes which have a size corresponding to the diameter of the pin, and which are provided in the said two legs 212A, 212B and in the tool body 211.

A tension spring 216C (or, more correctly, one such tension spring on each side of the tool body 211), operating between the driving rod means 216 and the tool body 211, tends to hold the tool in open position, i.e. with the operating lever 212 fully swung out, and the carriers 13A, 13B maximally spaced apart.

The tool body 211 is, together with the component parts carried by it (with the exception of the two carriers and the operating lever), preferably enclosed in a handle-shaped outer casing, e.g. embodied by two half-shells which are bounded together along the longitudinal plane of symmetry of the tool. The periphery R (FIG. 8) of this, otherwise not shown cases, follows substantially, with a certain addition, the boundary of the tool body 211 shown in the drawing.

To the rocker means 213B, more correctly to each rocker member 213B', 213B" is rigidly attached a resilient member, embodied by a bracket 215, which is resilient to a limited degree so as to be bendable in said plane of symmetry (i.e. substantially in the drawing plane of FIGS. 8 to 10) in a direction Q transversely to the longitudinal direction of the tool body 211 (i.e. substantially up or downward in FIGS. 8 to 10).

Such a resilient bracket 215 may be prefrerably integral with the respective rocker member 213B', 213B", provided the rocker member is made of material, such as e.g. steel plate, which has the necessary qualities. The bracket may then be produced with the aid of a conveniently shaped cut 214, penetrating the entire thickness of the respective rocker member 213B', 213B". The degree of resiliency of the bracket 215 may be defined by the kind and thickness of the material from which the rocker member is produced, and by the shape of the bracket's periphery.

At the free end 215A of the resilient bracket 215 is a hole 215A' provided for a retainer bolt 217A with the aid of which is a short link (or bridge) 217, pear-shaped in the illustrated example, at one its end attached to the rocker 213B. The link 217 has at its other end a circular hole with the same diameter as the pivot pin 214 mounted therein.

In the rocker member 213B', 213B" is a hole 214' provided, which is larger than the diameter of the pivot pin 214A, and which preferably is embodied by a longitudinal opening, for the passage of the said pivot pin 214A, so that the pin 214A can to a certain degree freely move therein. Consequently, the rocker means 213B is neither immediately, nor rigidly attached to its pivot pin 214A.

Thanks to this arrangement, various end spacements F (FIG. 9) may be obtained. By "end spacement" is understood the mutual spacement of the free ends 213A', 213B' of the two carriers 213A, 213B in the end position (the term "end position" will be explained below). The practical result thereof is that between jaws or die members attached to the two carriers can objects of various sizes (within certain limits), e.g. Aderend sleeves within the above mentioned cross-sectional range, be treated without need to re-adjust the tool.

In the preferred embodiment, where the rocker means 213B comprises one member on each side of the tool body 211, passes the rocker pivot pin 214A through the tool body 211 in a circular hole with a diameter corresponding to that of the pin, while for the retainer bolt 217A is a considerably larger opening 217A' (FIG. 8), possibly an arcuate slot having its centre of curvature in the pin 214A, provided in the tool body 211.

It will be appreciated, however, that a member in one of the above said means also may be connected to the member of the another means, and the bracket 215 be attached to the link 217, by pins which do not pass through the tool body, but terminate therebefore.

In the second terminal part 211B of the tool body 211 is an arcuate ratchet 217A arranged on the tool body 211, which together with a spring-affected (tension spring 217D) pawl 217B, pivotally mounted on the operating lever 217, defines a motion-compelling mechanism of the above mentioned kind, known per se.

Although it is particularly advantageous when in a tool with such a mechanism the end spacement is (within certain limits) automatically adjustable thanks to the construction of the rocker means 214 according to the present invention, this invention may be applied with advantage also in tools without a motion-compelling mechanism. By "end position" is in general understood the position of greatest mutual approachment of the two carrier means, defined e.g. by a stop means as 12C in FIG. 1, the length of a slot in the tool as slot 140A in FIG. 3, or by the operating lever bearing against the tool body, or the like.

In FIGS. 11 to 13 is shown a fourth embodiment 40 with a longitudinal tool body 311 defined by a load-bearing case or housing preferably of plastics, at the first terminal part 311A of which is an operative section OS located, and on the second terminal part 311B of which is an operating lever 317 journalled to the tool body with the aid of a lever pivot pin 317C.

The first terminal part 311A, in which the operative section OS is located, is bent upward, i.e. in the direction, from which the operating lever 312 is attached, and comprises two movable carrier means, viz. a first carrier means 313A and a second carrier means 313B. Both carrier means are mounted in the housing 311 with the aid of a common rocker pivot pin 314A.

Each carrier supports one operative means such as a jaw or die member 315A, 315B which may be exchangeable and affixed with the aid of a bolt 315B' or the like, as shown at the second carrier means 315B.

The said second carrier means 313B is embodied by a rocker which has two opposite, projecting arms 313B', 313B" which surround a recess E . The first projecting arm 313B' is at its free end provided with an opening 314' for mounting the rocker 313B on a rocker pivot pin 314B, anchored in the tool body 311, and the second arm 313B" is at its free end adapted for receiving the die member 315B, e.g. by having there a hole 315B" for the bolt 315B'.

The first carrier means 313A is in the illustrated example integral with the respective die member 315A, and is defined by an eyelet which may be slipped on the rocker pivot pin 314A. It will be understood that the entire small unit, consisting of the carrier 213A and the die member 315A, is readily exchangeable (e.g. when the die member 315B is exchanged).

The two arms 313B', 313B'' of the rocker 313B define together an essentially C- or G-shaped formation which is resilient to a limited degree, the degree of resiliency being defined by the kind and thickness of the material (preferably metal such as steel) from which the second carrier 314 is produced, and by the shape of its periphery. An alternative circumferantial shape, such as e.g. one with a recess S (FIG. 11A), resulting in an extended arm 313B', will give a higher degree of resiliency, etc.

The rocker 313A is on its periphery provided with a circular recess 313C, which extends over more than 180° and defines one part of a "flat" ball-and-socket-type joint, the other part of which will be explained below.

On the rocker pivot pin 314B is further a longitudinal die beam 318 pivotally mounted at its one end, which beam is at its opposite end 318'' affected by a compression spring 318A and a setting screw 318B, both mounted in the housing 311.

The adjacent edges 315A' of the first carrier 313A and 318' of the die beam 318 are congruently shaped, so that they abut against one another when the two parts 315A and 318 are mounted on the rocker pivot pin 314A, defining then one rigid unit pivotable about said pin.

This unit can, of course, also be made in one piece, 328, as is shown in FIG. 13. The two-piece embodiment has, however, the advantage that the carrier 313A (together with the die member 315A) is readily exchangeable.

It will be appreciated that while the second carrier means 315B is movable for operative purposes, the first carrier 315B is movable for adjustment purposes, and a desired position of the die member 315A relative the tool body 311 may be readily set by adjusting the setting screw 318B, against which the die beam 318 is constantly urged by the spring 318A.

The operating lever 312 has at its attachment end a bent, broader part 312' in which the lever pivot pin 312C is mounted. An end stop bolt 312D defines the most swung-out position of the operating lever 312.

A driving rod means defined by a single, rigid driving rod 316 is at its first end 316A journalled to the rocker 313B (spacedly from the rocker pivot pin 314A) with the aid of a circular projection 316A' which has a circumference of more than 180°, and which, embodying the second part of the said "flat" ball-and-socket-type joint, is inserted into the said recess 313C in the rocker 313B. A projection 318D on the die beam 318 stabilizes laterally on one side (and the inner wall of the housing 311 on the other side) the ball-and-socket-type joint 313C/316A'.

The driving rod 316 is further at its second end 316B, with the aid of a pivot pin 316B' pivoted to the the operating lever 312 within its broader part 312', and is at this second end provided with a short ratchet 317A, which is located on a bent-off extension 316C of the driving rod 316, and which, together with a spring-affected (extension spring 317C) pawl 317B, pivotally mounted on the operating lever 312, defines a motion-compelling mechanism of a kind known per se.

The driving rod 316 is constantly affected by an extension spring 316D in the sense of holding the pair of die members 315A, 315B in their open position.

The two die carrier means 313A and 313B with the die members 315A, 315B are so dimensioned, that the said die members abut one to another before the toggle mechanism defined by the operating lever 312 and the driving rod 316 reaches its streched position.

What is claimed is:

1. A pliers type tool comprising:

a tool body having a longitudinal axis, a first end, a second end, and an intermediate portion, said intermediate portion being disposed between said first end and said second end along said longitudinal axis of said tool body, an operative part being provided at said first end of said tool body for the treatment of a work-piece, said operative part comprising a fixed first jaw carrier means and a movable, second jaw carrier means;

an operating lever having a longitudinal axis, a first, free end and a second attachment end, said operating lever being pivotally coupled to said second end of said tool body at said second, attachment end for pivotal motion between a swung-out position wherein said operating lever extends laterally at an angle from said axis of said tool body and a folded-down position wherein said operating lever is substantially parallel to said tool body, said operating lever being attached to said tool body so as to define a reversed lever arrangement;

driving rod means having a longitudinal axis and first and second ends, said driving rod means being pivotally coupled at said first end to said second jaw carrier means and at said second end to said operating lever means so that pivotal motion of said operating lever means effects motion of said drive rod means which in turn effects motion of said second jaw carrier means;

said operative part including said first and second jaw carrier means projecting laterally from said longitudinal axis of said tool body in the direction that said operating lever is swung-out, said operating lever terminating, in said folded-down position, short of said operating part, said free end of said operating lever being disposed in said folded-down position adjacent to but not projecting laterally further than said operating part.

2. A tool, as defined in claim 1, wherein at the second terminal part of the tool body a portion which projects laterally relative to an axis of the intermediate part is provided, the operating lever being pivotally mounted to said projecting portion with a lever pivot pin.

3. A tool, as defined in claim 1, wherein the combination of said operating lever and said driving rod means defines a toggle mechanism settable so that a straight line connecting the two pivot means of the driving rod means subtends an acute angle of less than 10° with an extension of a straight line connecting said pivotal mounting of said operating lever to said tool body with the pivot means at the second end of the driving rod means.

4. A tool as defined in claim 1, wherein an end of an operative stroke of said toggle mechanism occurs before said toggle mechanism reaches a fully stretched position.

5. A tool, as defined in claim 1, provided with a motion-compelling mechanism comprising a spring-affected pawl pivotally mounted on the operating lever and co-operating with a ratchet located on the second terminal part of one of the driving means and tool body.

6. A tool, as defined in claim 5, wherein the ratchet is located on a bent-off projection of the driving rod means extending beyond the pivot means at the second end of the driving rod means.

7. A tool, as defined in claim 1, provided with a motion-compelling mechanism comprising a spring-affected pawl pivotally mounted on the operating lever and co-operating with a ratchet, wherein the ratchet is located at the second terminal part of the tool body.

8. A tool, as defined in claim 1, wherein the second carrier means effects a rectilinear movement and is embodied by a slide displaceably mounted in a rectilinear track in the tool body, and a projecting web rigidly attached to the slide.

9. A tool, as defined in claim 8, wherein said track is defined by spaced apart longitudinal openings in the tool body, and the slide is provided with guide taps which slidably engage said openings.

10. A tool, as defined in claim 1, wherein the second carrier means effects a rectilinear movement, and in the area of at least one of the two carriers means is a locator mounted which co-operates with the adjacent die member in order to define the correct position in which the work-piece shall be treated.

11. A tool, as defined in claim 10, wherein the locator comprises a plate which to a limited extent is displaceable against spring force along the adjacent die member, parallel with the direction of displacement of the second carrier means, and which has a terminal edge in which is a recess provided adjacent each die element, the lowest point in any such recess lying, in the most advanced position of the plate, closer to the terminal edge than to the die element.

12. A tool, as defined in claim 10, wherein the locator is embodied by a bar which is firmly attached to the adjacent die member and has a terminal edge in which is a recess provided adjacent each die element, the lowest point in any such recess lying, in the most advanced position of the plate, closer to the terminal edge than to the die element.

13. A tool, as defined in claim 10, wherein the locator is embodied by a bar which is firmly attached to the tool body in a position where it at least in the most advanced position of the second carrier means projects into the area of the adjacent die member.

14. A tool, as defined in claim 1, wherein for adjusting purposes one pivot means of the driving rod means, or the lever pivot pin is embodied by a pivot pin having an eccentrical central portion and co-operating with a means for securing a selected rotational position thereof.

15. A manually operated pliers-type tool comprising:

an elongated tool body defining a first handle means and having a longitudinal axis, a first terminal part, an intermediate part and a second terminal part, said intermediate part being disposed between said first terminal part and said second terminal part along the longitudinal axis of said first handle means;

an operative section defined at said first terminal part for treating a work-piece by compression, said operative section comprising a first carrier means for a first operative means and a second carrier means for a second operative means, said second carrier means being mounted so as to be movable toward and away from said first carrier means;

a longitudinal operating lever defining a second handle means, said operating lever having a first end pivotally mounted with a lever pivot pin to said second terminal part of said tool body and a second, free end, said operating lever being pivotable between a swung-out position wherein said operating lever extends laterally at an angle from said longitudinal axis of said tool body and a folded-down position wherein said operating lever is substantially parallel to said tool body, said second handle means being attached to said first handle means so as to define a reversed handle arrangement;

rigid driving rod means having a first end pivotally coupled to said second carrier means and a second end pivotally coupled to said operating lever at a point spaced from said lever pivot pin, said driving rod means defining together with said operating lever a toggle mechanism for transmitting force and motion of said operating lever relative to said tool body to said second carrier means;

said second carrier means comprising a rocker means pivotally mounted in said operative section;

said rocker means including means for mounting said second operative means thereto and, spaced therefrom, aperture means for receiving a bolt for mounting said rocker means to one of said tool body and a first end of a link pivotally mounted at a second end thereof to said tool body;

a resilient member disposed between said means for mounting said second operative means and said aperture means, deformation of said resilient member under a predetermined load effecting motion of said second operative means.

16. A tool, as defined in claim 15, wherein the rocker is rigidly connected with at least one bracket which to a limited degree is resiliently bendable in the plane of the rocker, and which has a free end, where the said opening for a connecting bolt is located, and wherein a link member is provided which at one its end is with the aid of said connecting bolt attached to the said bracket, and at its other end is provided with an opening for mounting on a rocker pivot pin which is anchored in the tool body.

17. A tool, as defined in claim 16, wherein said bracket or brackets are integral with the rocker by being cut out therefrom.

18. A tool, as defined in claim 16, wherein in the rocker is provided an opening through which the rocker pivot pin may pass, and which is larger than the diameter of the said pin, so that the rocker may change its relative position to the tool body to the extent permitted by the resiliency of the bracket.

19. A tool, as defined in claim 16, wherein the tool body is embodied by a flat plate member, and the second die member carrier means and the driving rod means are embodied by one rocker and one driving rod respectively on each side of the tool body, the two members in each such pair being interconnected by pins which pass through openings in the tool body, the openings for the pins connecting the two driving rods members being defined by arcuate slots.

20. A tool, as defined in claim 15, wherein the rocker has two juxtaposed, projecting arms which surround a recess and define together an essentially C- or G-shaped formation which embodies said resilient means, and on the one end of which is the said area for affixing the second operative means, and at the other end the opening for a connecting bolt, defined by a pivot pin anchored in the tool body, located.

21. A tool, as defined in claim 20, wherein the first carrier means is pivotable for adjusting purposes by being mounted on a pivot tap and being attached to an elongated die beam so as to define a rigid unit therewith, said die member beam being spacedly from the first carrier means affected by a setting means such as a setting screw.

22. A tool, as defined in claim 20, wherein the first operative means is integral with the first carrier means, and the first carrier means is embodied by an eylet member which is pivotally mountable on the same pivot pin as the second carrier means.

23. A tool, as defined in claim 20, wherein the pivot means at the first end of the driving rod means is embodied by a ball-and-socket-type joint which comprising a circular projection on the first end of the driving rod means, and a circular recess on the periphery of the rocker for accommodating the said projection, both the projection and the recess having a circumference of more than 180°.

24. A tool, as defined in claim 20, wherein that part of the tool body and tool, which defines the operative section, projects relative the said intermediate part in the direction from which the operating lever is attached to the tool body, and the operating lever terminates, in its folded-down position, before the said projecting part, and is level therewith.

25. A tool, as defined in claim 20, wherein the tool body is defined by a load-bearing housing of plastic material.

26. A manually operated pliers-type tool comprising, in combination:

an elongated tool body defining a first handle means, said elongated tool body having a first terminal part, an intermediate part, and a second terminal part, said intermediate being disposed between said first terminal part and said second terminal part along a longitudinal axis of said elongated tool body, an operative section being provided at said first terminal part for treating a work-piece by compression, said operative section comprising a first carrier means for supporting a first operative means and a second carrier means for supporting a second operative means, said second carrier means being moveable toward said first carrier means during an operative stroke;

an operating lever having a longitudinal axis and defining a second handle means, said operating having lever having first end, pivotally mounted via a lever pivot pin to said second terminal part of said tool body so that said operating lever is pivotal relative to said tool body between a swung-out position wherein operating lever extends laterally at an angle from longitudinal axis of said tool body and a folded-down position wherein said operating lever is substantially parallel to said tool body, said second handle means being attached to said first handle means so as to define a reversed handle arrangement;

a rigid driving rod means having a first end pivotally coupled to said second carrier means and a second end pivotally coupled to said operating lever at a point spaced from said lever pivot pin so that said driving rod means together with said operating lever defines a toggle mechanism for achieving said operative stroke of said second carrier means by transmitting force and motion of said operating lever means to the second carrier means when the operating lever means is swung said lever pivot pin, said second carrier means being attached to one of said tool body and said driving rod means so that its position relative to said tool body can be altered without changing the position of said operating lever relative to said tool body and wherein said operative section of said tool body projects laterally relative to said intermediate part in the direction that said operating lever is swung-out and said operating lever terminates in its most folded-down position short of said projecting part and without projecting laterally beyond said first and second carrier means.

* * * * *